US010710829B2

(12) United States Patent
Yamaguchi et al.

(10) Patent No.: US 10,710,829 B2
(45) Date of Patent: Jul. 14, 2020

(54) PAPER CONVEYANCE DEVICE, IMAGE FORMING APPARATUS, PAPER CONVEYANCE CONTROL METHOD, AND RECORDING MEDIUM

(71) Applicant: KONICA MINOLTA, INC., Chiyoda-ku, Tokyo (JP)

(72) Inventors: Hiroshi Yamaguchi, Toyokawa (JP); Hitoshi Asano, Toyokawa (JP); Toshikazu Higashi, Toyokawa (JP); Tomonobu Tamura, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/201,452

(22) Filed: Nov. 27, 2018

(65) Prior Publication Data

US 2019/0177102 A1 Jun. 13, 2019

(30) Foreign Application Priority Data

Dec. 8, 2017 (JP) ..... 2017-235955

(51) Int. Cl.
*B65H 7/06* (2006.01)
*B65H 5/06* (2006.01)
(Continued)

(52) U.S. Cl.
CPC ..... *B65H 7/06* (2013.01); *B65H 5/062* (2013.01); *B65H 5/38* (2013.01); *G03G 15/55* (2013.01);
(Continued)

(58) Field of Classification Search
CPC ..... B65H 7/06; B65H 5/38; B65H 2513/11; B65H 2404/6111; B65H 2515/32; B65H 2220/02; B65H 2220/01
See application file for complete search history.

(56) References Cited

U.S. PATENT DOCUMENTS 8,152,164 B2 * 4/2012 Yamamoto ..... B65H 5/062 271/242
9,517,905 B2 * 12/2016 Yoshimizu ..... B65H 5/068
(Continued)

FOREIGN PATENT DOCUMENTS

EP 3243775 A1 * 11/2017 ..... B65H 3/0669
JP 2011081347 A 4/2011
JP 2011128398 A 6/2011

*Primary Examiner* — Patrick Cicchino
(74) *Attorney, Agent, or Firm* — Holtz, Holtz & Volek PC

(57) ABSTRACT

A paper conveyance device includes: an upstream roller and a downstream roller being arranged at an interval in a paper conveyance path; paper conveyance guides being arranged between the upstream and downstream roller in the paper conveyance path to guide both surfaces of paper along the paper conveyance path during paper conveyance; drivers that drive the upstream and downstream roller independently; and a processor that measures the load torques on the upstream and downstream roller, that judges whether or not the paper is rubbing against one of the paper conveyance guides with reference to the load torques on the upstream and downstream roller, the load torques being obtained by the processor, and that performs controlled paper conveyance with reference to the load torques on the upstream and downstream roller depending on the result of the judgment being obtained by the processor.

14 Claims, 11 Drawing Sheets

(51) Int. Cl.
*B65H 5/38* (2006.01)
*G03G 15/00* (2006.01)

(52) U.S. Cl.
CPC .. *G03G 15/6529* (2013.01); *B65H 2404/6111* (2013.01); *B65H 2515/32* (2013.01)

(56) References Cited

U.S. PATENT DOCUMENTS

| | | | | |
|---|---|---|---|---|
| 10,435,261 | B2 * | 10/2019 | Miyajima | G03G 15/6529 |
| 2011/0064496 | A1 * | 3/2011 | Ashikawa | G03G 15/657<br>399/361 |
| 2011/0148035 | A1 | 6/2011 | Yamamoto et al. | |
| 2015/0239233 | A1 * | 8/2015 | Regelsberger | B41F 33/0036<br>101/481 |
| 2019/0119058 | A1 * | 4/2019 | Chiba | B65H 7/02 |

* cited by examiner

Table 1: On/off Settings of Conveyance Control

| | Double-sided Printing | Single-sided Printing |
|---|---|---|
| Paper of 100 g/$m^2$ or less | Off | Off |
| Paper of 200 g/$m^2$ or less | On | Off |
| Paper of 300 g/$m^2$ or less | On | Off |

FIG.4

Table 2: Control Method

Table 2-1:
The load torque on the upstream roller only is higher than normal

| | Load Torque | Motor RPM |
|---|---|---|
| Upstream Roller | 2 mN・m or more | 2100 rpm → Down by 10% |
| Downstream Roller | — | 2100 rpm → Up by 10% |

Table 2-2:
The load torque on the downstream roller only is higher than normal

| | Load Torque | Motor RPM |
|---|---|---|
| Upstream Roller | — | 2100 rpm → Up by 10% |
| Downstream Roller | 2 mN・m or more | 2100 rpm → Down by 10% |

Table 2-3:
The load torques on the both rollers are lower than normal

| | Load Torque | Motor RPM |
|---|---|---|
| Upstream Roller | Less than 2 mN・m | Maintain the last RPM |
| Downstream Roller | Less than 2 mN・m | Maintain the last RPM |

FIG.6

Table 3: Control Method 2
| | Paper of 200 g/m² or less | | Paper of 300 g/m² or less |
|---|---|---|---|
| | Paper 1 | Paper 2 | Paper 3 |
| Timing for Start | 100ms | 130ms | 200ms |
FIG.7
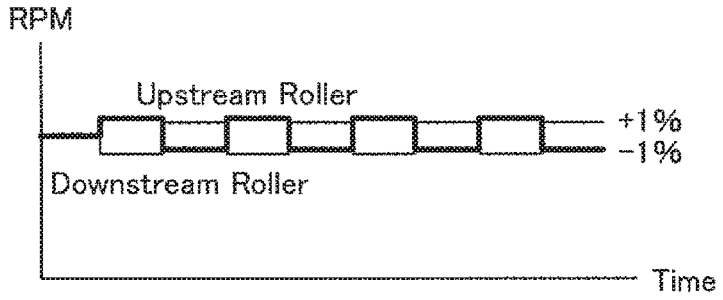
FIG.8
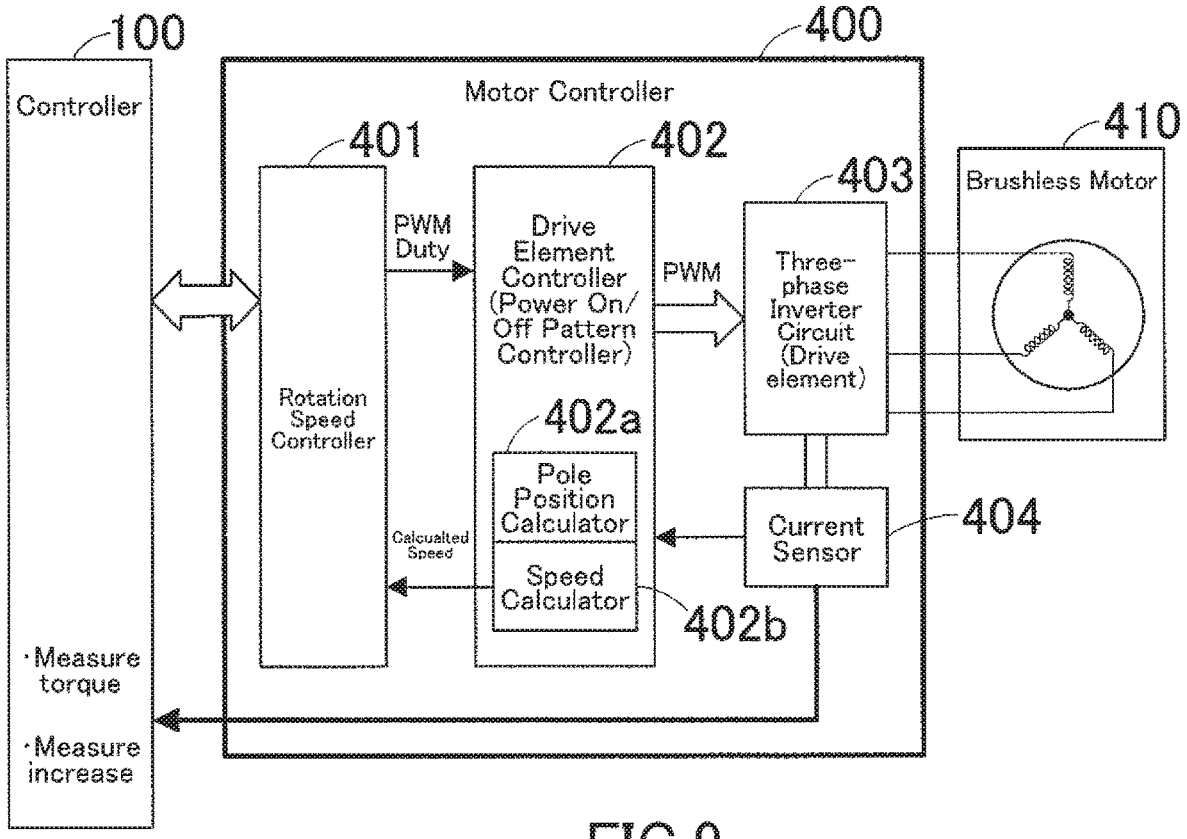
FIG.9

PAPER CONVEYANCE DEVICE, IMAGE FORMING APPARATUS, PAPER CONVEYANCE CONTROL METHOD, AND RECORDING MEDIUM

The disclosure of Japanese Patent Application No. 2017-235955 filed on Dec. 8, 2017, including description, claims, drawings, and abstract, is incorporated herein by reference in its entirety.

BACKGROUND

Technological Field

The present invention relates to: a paper conveyance device to be loaded in an image forming apparatus, for example, and that conveys a print medium such as copy paper; an image forming apparatus provided with this paper conveyance device; a paper conveyance control method to be implemented by this paper conveyance device; and a recording medium.

Description of the Related Art

When copy paper is conveyed in a conventional image forming apparatus, upstream rollers release the paper as the leading edge of the paper reaches downstream rollers. By controlled paper conveyance like this, the conventional image forming apparatus achieves in reduction of the amount of power consumed by its driving motor for the upstream rollers.

The conventional image forming apparatus may be provided with paper conveyance guides; the paper conveyance guides are arranged in parallel between the upstream and downstream roller in the paper conveyance path to guide both surfaces of the paper along the paper conveyance path during paper conveyance.

The paper conveyance path is partly steep and the paper conveyance guides to that section of the path thus must be shaped in an arch having a large radius of curvature. So, when the downstream rollers pull the paper in during paper conveyance, the paper can rub against one of the paper conveyance guides, causing a friction torque and an increase in the load torque on the motor. In this case, the leading edge of the paper rubs against one of the paper conveyance guides strongly because a torque exerted to pull in the leading edge of the paper acts on the paper conveyance guide.

For example, when the downstream rollers pull tough paper in, the paper rubs against one of the paper conveyance guides strongly, causing a high friction force and an increase in the load torque on the downstream rollers. Driving motors for the downstream rollers thus have to increase output torque.

Japanese Unexamined Patent Application Publication No. 2011-081347 proposes a conveyance device that is capable of reducing torque delivery between two rollers. The conveyance device is provided with a first conveyance roller, a first driving roller, a second conveyance roller, and a second driving roller each that conveys a medium; and a torque information sensor that obtains information of torque acting on the first conveyance roller. The conveyance device regulates the rotation speed of the second driving roller with reference to the difference between the torque information obtained by the torque information sensor during medium conveyance only by the first conveyance roller and the torque information obtained by the torque information sensor during medium conveyance by both the first and second conveyance roller.

Japanese Unexamined Patent Application Publication No. 2011-128398 proposes an image forming apparatus that minimizes a decline in the quality of toner images to be transferred onto a print medium. The image forming apparatus is provided with: a first roller that conveys a print medium; a second roller that conveys the print medium, the second roller being disposed downstream from the first roller in the direction of print medium conveyance; a first sensor that senses a bend of a predetermined size by contact with the print medium, the first sensor being disposed between the first and second roller; a second sensor that senses a driving torque of a predetermined amount on the first or second roller; and a regulator that regulates the rotation speed of the first or the second roller for print medium conveyance when the first sensor senses a bend of a predetermined size or when the second sensor senses a driving torque of a predetermined amount, whichever is the first to occur after the start of print medium conveyance.

Japanese Unexamined Patent Application Publication No. 2011-081347 and No. 2011-128398 do not bring a solution to the problem: the load torque on a roller driving motor increases because paper rubs against a paper conveyance guide.

SUMMARY

The present invention, which has been made in consideration of such a technical background as described above, relates to a paper conveyance device including: a upstream and downstream roller that are arranged at an interval in a paper conveyance path; and paper conveyance guides that are arranged between the upstream and downstream roller to guide both surfaces of paper along the paper conveyance path during paper conveyance. The present invention is aimed at providing this paper conveyance device, a paper conveyance method, and a recording medium that are capable of minimizing an increase in the load torques on the upstream and downstream roller, caused by the paper rubbing against the paper conveyance guides.

A first aspect of the present invention relates to a paper conveyance device including:

an upstream roller and a downstream roller being arranged at an interval in a paper conveyance path;

paper conveyance guides being arranged between the upstream and downstream roller in the paper conveyance path to guide both surfaces of paper along the paper conveyance path during paper conveyance;

drivers that drive the upstream and downstream roller independently; and a processor that measures the load torques on the upstream and downstream roller, that judges whether or not the paper is rubbing against one of the paper conveyance guides with reference to the load torques on the upstream and downstream roller, the load torques being obtained by the processor, and that performs controlled paper conveyance with reference to the load torques on the upstream and downstream roller depending on the result of the judgment being obtained by the processor.

A second aspect of the present invention relates to a paper conveyance control method to be implemented by a paper conveyance device including:

an upstream roller and a downstream roller being arranged at an interval in a paper conveyance path;

paper conveyance guides being arranged between the upstream and downstream roller in the paper conveyance path to guide both surfaces of paper along the paper conveyance path during paper conveyance; and drivers that drive the upstream and downstream roller independently, the paper conveyance control method including:

measuring the load torques on the upstream and downstream roller;

judging whether or not the paper is rubbing against one of the paper conveyance guides with reference to the load torques on the upstream and downstream roller, the load torques being obtained; and performing controlled paper conveyance with reference to the load torques on the upstream and downstream roller depending on the result of the judgment being obtained.

A third aspect of the present invention relates to a non-transitory computer-readable recording medium storing a paper conveyance control program for a paper conveyance device including:

an upstream roller and a downstream roller being arranged at an interval in a paper conveyance path;

paper conveyance guides being arranged between the upstream and downstream roller in the paper conveyance path to guide both surfaces of paper along the paper conveyance path during paper conveyance; and drivers that drive the upstream and downstream roller independently, the paper conveyance control program making a computer of the paper conveyance device execute:

measuring the load torques on the upstream and downstream roller;

judging whether or not the paper is rubbing against one of the paper conveyance guides with reference to the load torques on the upstream and downstream roller, the load torques being obtained; and performing controlled paper conveyance with reference to the load torques on the upstream and downstream roller depending on the result of the judgment being obtained.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

FIG. 4 is a table showing on and off settings of controlled paper conveyance.

FIG. 6 is a set of tables for reference in describing an example of a paper conveyance control method.

FIG. 7 is a table for reference in describing another example of a paper conveyance control method.

FIG. 8 is a chart for reference in describing an example of a paper conveyance control method on the condition where the load torques on the upstream and downstream roller are not sensed.

FIG. 9 is a block diagram illustrating a configuration of a sensor-less three-phase brushless motor as a driving motor for each roller and of a motor controller that controls the brushless motor.

DETAILED DESCRIPTION OF EMBODIMENTS

Hereinafter, one or more embodiments of the present invention will be described with reference to the drawings. However, the scope of the invention is not limited to the disclosed embodiments.

Figure 1:
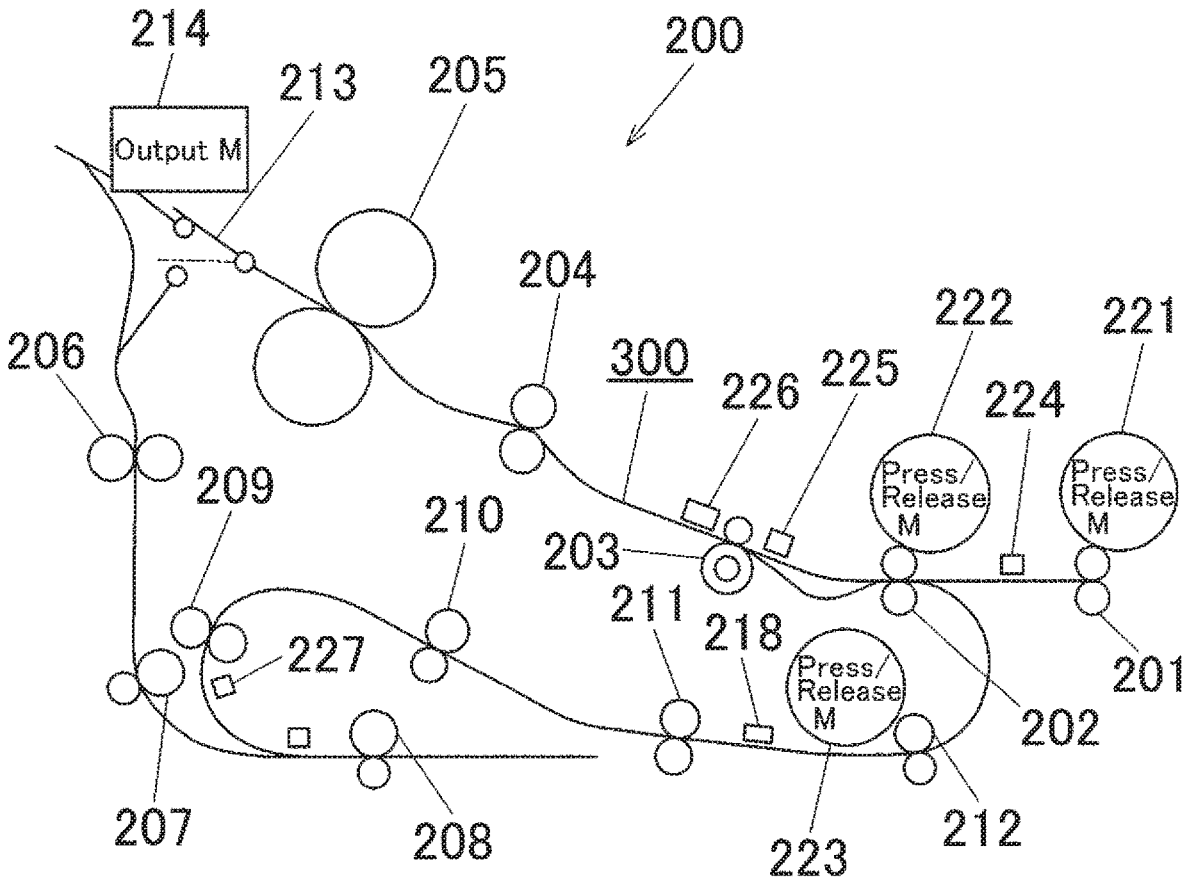
FIG. 1 is a schematic diagram illustrating a configuration of a paper conveyance section of an image forming apparatus according to one embodiment of the present invention.

FIG. 1 is a schematic diagram illustrating a configuration of a paper conveyance section 200 of an image forming apparatus according to one embodiment of the present invention.

The image forming apparatus may be a multifunctional digital machine referred to as MFP, a printer, a copier, or a facsimile, for example.

The paper conveyance section 200 is provided with a pair of conveyance rollers 201 that conveys paper received from a paper tray (not shown in the figure). Also, the paper conveyance section 200 is provided with: a pair of bending rollers 202; a pair of paper stop rollers 203; a pair of second transfer rollers 204; and a pair of fusing rollers 205 that constitutes a fuser; and these are located in this order downstream from the conveyance rollers 201. The second transfer roller 204 is a roller that transfers toner images formed on an intermediate transfer belt (not shown in the figure) onto paper. The paper stop roller 203 is a roller that feeds the paper to the second transfer roller 204 at a right timing. The bending roller 202 is a roller that bends the paper to prevent the paper from being pushed upward out of the conveyance path. The fusing roller 205 firmly fuses the toner images transferred onto the paper by the second transfer roller 204. After that, a paper output motor 214 outputs the paper carrying the fused toner images, onto a paper output tray not shown in the figure.

In this embodiment, the image forming apparatus is further provided with a mechanism that enables double-sided printing by turning the paper upside down during paper conveyance. Specifically, the mechanism is provided with a path switching gate 213; after the fusing roller 205 firmly fuses the toner images on one side of the paper, the path switching gate 213 delivers it to a paper output tray when it is a single-sided printing job and delivers it to a pair of conveyance rollers 206 when it is a double-sided printing job, by switching the conveyance path. The mechanism is further provided with a pair of conveyance rollers 207 and a pair of turning rollers 208 that are located in this order downstream from the conveyance roller 206. The turning roller 208 is a roller that turns upside down the paper received from the conveyance roller 207, by switching it back. After being turned, the paper is conveyed to the bending roller 202 by way of pairs of conveyance rollers 209, 210, 211, 212 that are located at intervals. All these rollers constitute a paper conveyance path 300.

Figure 2:
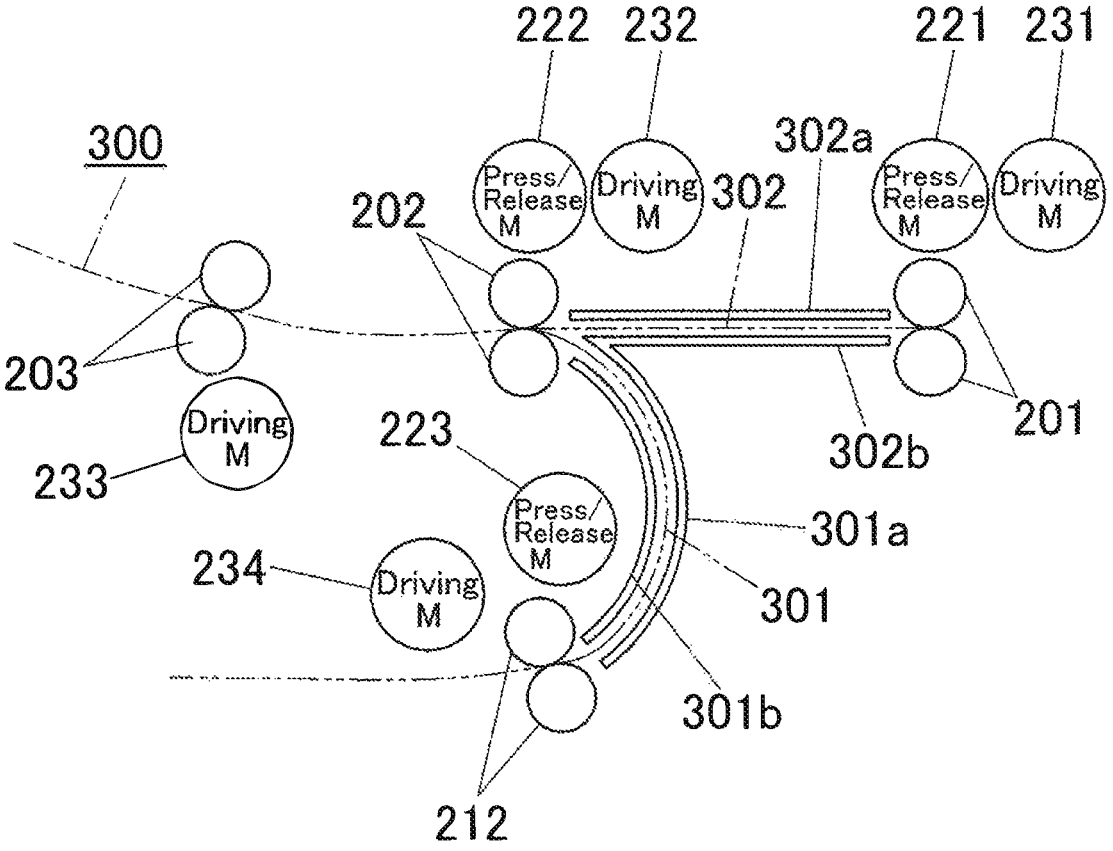
FIG. 2 illustrates an enlarged view of a part of the paper conveyance section of FIG. 1.

As referred to FIG. 2, the conveyance roller 201, the bending roller 202, the paper stop roller 203, and the conveyance roller 212 on the double-sided printing conveyance path are, respectively, driven by driving motors 231, 232, 233, and 234. Similarly, the other rollers are driven by their corresponding rollers, which is not shown in the figure. The conveyance rollers 201, the bending rollers 202, and the conveyance rollers 212 are, respectively, brought into contact and separated by the press and release motors 221, 222, and 223. The conveyance rollers 201, the bending rollers 202, and the conveyance rollers 212 are thus allowed to press and release the paper while the paper is passing through.

As referred to FIG. 2, paper conveyance guides 302*a* and 302*b* that are made of plastic, for example, are closely located in parallel between the conveyance roller 201 and the bending roller 202 in a paper conveyance path 302. The paper conveyance guides 302*a* and 302*b* are thus allowed to guide both surfaces of the paper along the paper conveyance path 302 during paper conveyance. Similarly, paper conveyance guides 301*a* and 301*b* that are made of plastic, for example, are closely located in parallel between the conveyance roller 212 and the bending roller 202 in a paper conveyance path 301 that is steep. The paper conveyance guides 301*a* and 301*b* are thus allowed to guide both surfaces of the paper along the paper conveyance path 301 during paper conveyance.

Now referring to the configuration of the paper conveyance section 200 in FIG. 1, upon receiving the paper from the conveyance roller 201, the bending roller 202 bends the paper by bringing the paper in contact with the paper stop roller 203 that is stopped or running in the reverse direction of paper conveyance. The paper stop roller 203 feeds the paper at the timing for second image transfer, and the second transfer roller 204 transfers toner images onto the paper. The fusing roller 205 firmly fuses the toner images on the paper. The paper is then output if this is a single-sided printing job. Otherwise, the path switching gate 213 switches the conveyance path and the turning roller 211 turns the paper upside and down by switching it back. By way of the conveyance rollers 209 to 212, the paper returns to the bending roller 202 for double-sided printing.

Figure 3:
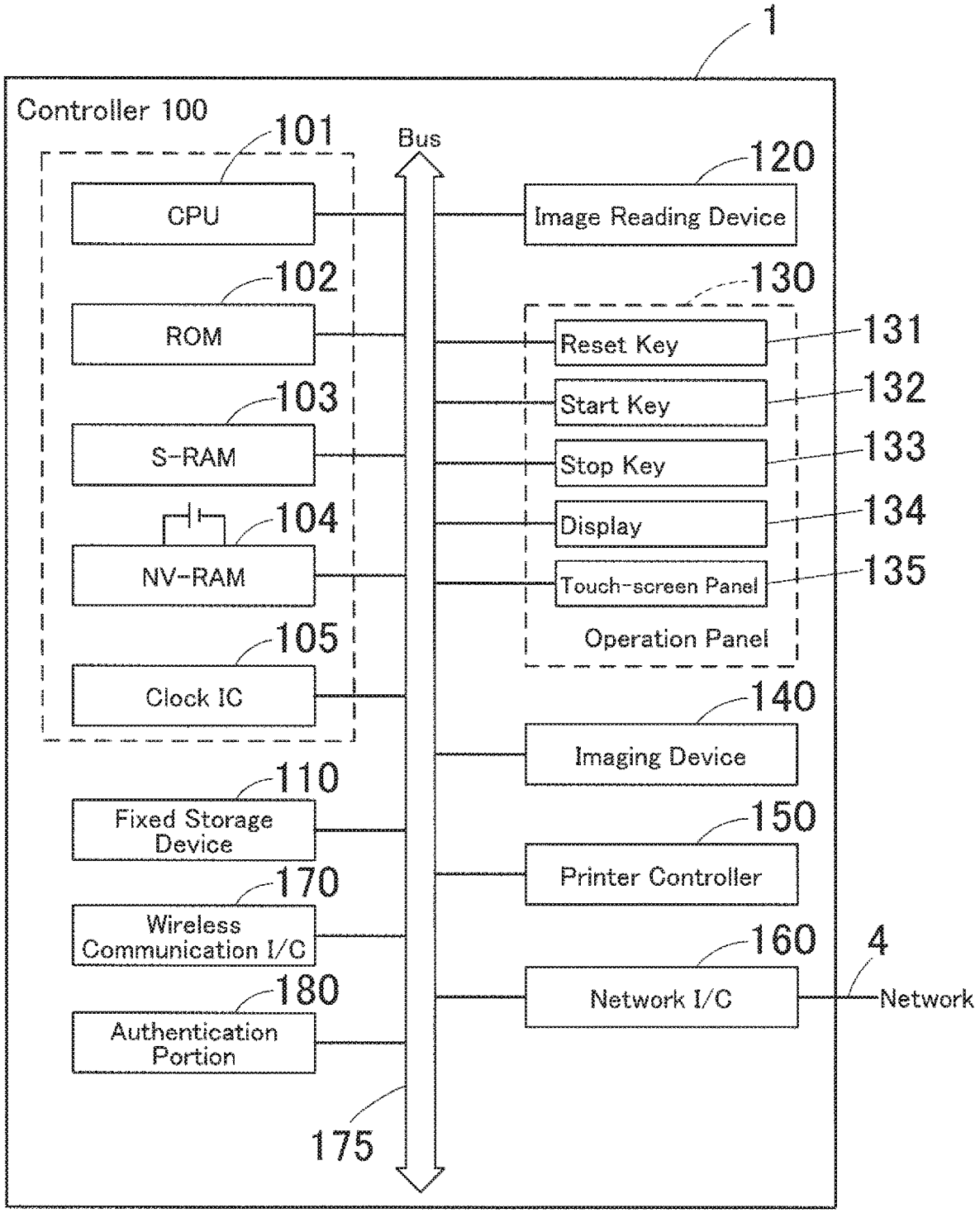
FIG. 3 is a block diagram illustrating an electrical configuration of the image forming apparatus.

FIG. 3 is a block diagram illustrating an electrical configuration of the image forming apparatus.

As illustrated in FIG. 3, the image forming apparatus 1 is essentially provided with a processor 100, a fixed storage device 110, an image reading device 120, an operation panel 130, an imaging device 140, a printer controller 150, a network interface (network I/F) 160, a wireless communication interface (wireless communication I/F) 170, and an authentication portion 180, all of which are connected to each other through a system bus 175.

The processor 100 is essentially provided with a central processing unit (CPU) 101, a read-only memory (ROM) 102, a static random access memory (S-RAM) 103, a non-volatile random access memory (NV-RAM) 104, and a clock IC 105.

The CPU 101 controls the image forming apparatus 1 in a unified and systematic manner by executing operation programs stored on a recording medium such as the ROM 102. For example, the CPU 101 controls the image forming apparatus 1 to make its copier, printer, scanner, and facsimile function run. Specifically, in this embodiment, the CPU 101 controls paper conveyance and other operations during a copy or print job that makes the imaging device 140 form toner images.

The ROM 102 stores programs for the CPU 101 to execute and other data.

The S-RAM 103 serves as a workplace for the CPU 101 to execute programs and temporarily stores the programs, data to be used by the programs, and other data.

The NV-RAM 104 is a battery backed-up non-volatile memory and stores various settings and information related to image forming and other data.

The clock IC 105 indicates time and also serves as an internal timer to measure the processing time, for example.

The fixed storage device 110 consists of a hard disk drive, for example, and stores programs and data of various types.

The image reading device 120 is essentially provided with a scanner unit as an imaging portion. The image reading device 120 obtains an image by scanning a document put on a platen and converts the obtained image into digitally formatted image data that can be constituted by electric signals.

The operation panel 130 allows the user to give instructions such as jobs to the image forming apparatus 1 and to configure various settings. The operation panel 130 is essentially provided with a reset key 131, a start key 132, a stop key 133, a display 134, and a touch-screen panel 135.

The reset key 131 allows the user to reset settings. The start key 132 allows the user to start operation, for example, start scanning. The stop key 133 allows the user to stop operation when it is pressed.

The display 134 is a liquid-crystal display device, for example, displaying messages, various operation screens, and other information. The touch-screen panel 135 is disposed on the display screen of the display 134, and detects a user touch event.

The imaging device 140 prints copy images on paper and outputs the printed paper; the copy images are formed on the basis of image data obtained from a document by the image reading device 120 and on the basis of print data received from external apparatuses such as terminal apparatuses.

The printer controller 150 forms copy images on the basis of print data received by the network interface 160.

The network interface (network I/F) 160 serves as a transmitter-receiver that exchanges data with external apparatuses such as user terminals through a network 4. The wireless communication I/F 170 is an interface to communicate with external apparatuses using near-field wireless communication technology.

The authentication part 180 obtains the identification information of a user trying to logon, and performs authentication by comparing the identification information to the proof information stored on a recording medium such as the fixed storage device 110.

Hereinafter, controlled paper conveyance using upstream and downstream rollers will be described in detail. Here, in this embodiment to be described below, when it is a single-sided printing job, the upstream roller is the conveyance roller 201 disposed upstream from the bending roller 202; when it is a double-sided printing job, the upstream roller is the conveyance roller 212 disposed upstream from the bending roller 202 in the double-sided printing conveyance path. When it is either a signle-sided or double-sided printing job, the downstream roller is the paper stop roller 203; the downstream roller may be the bending roller 202 instead. Hereinafter, the conveyance roller 201 will be also referred to as "upstream roller 201", the conveyance roller 212 will be also referred to as "upstream roller 212", and the paper stop roller 203 will be also referred to as "downstream roller 203".

The upstream roller 201 feeds paper; the paper is conveyed to the bending roller 202 and then to the downstream roller 203. When controlled paper conveyance is not necessary, the upstream rollers 201 release the paper upon a linear distance of 3 to 4 mm, for example, being traveled by the downstream rollers 203. When controlled paper conveyance is necessary, the upstream rollers 201 do not release the paper. Instead, the bending rollers 202 release the paper upon a linear distance of 3 to 4 mm, for example, being conveyed from the leading edge of the paper by the downstream rollers 203. When the paper stop roller 203 starts oscillating in a CD direction (main scanning direction) during paper conveyance, the upstream rollers 201 release the paper. After the oscillation disappears, the upstream rollers 201 press the paper again to resume paper conveyance.

Figure 5A:
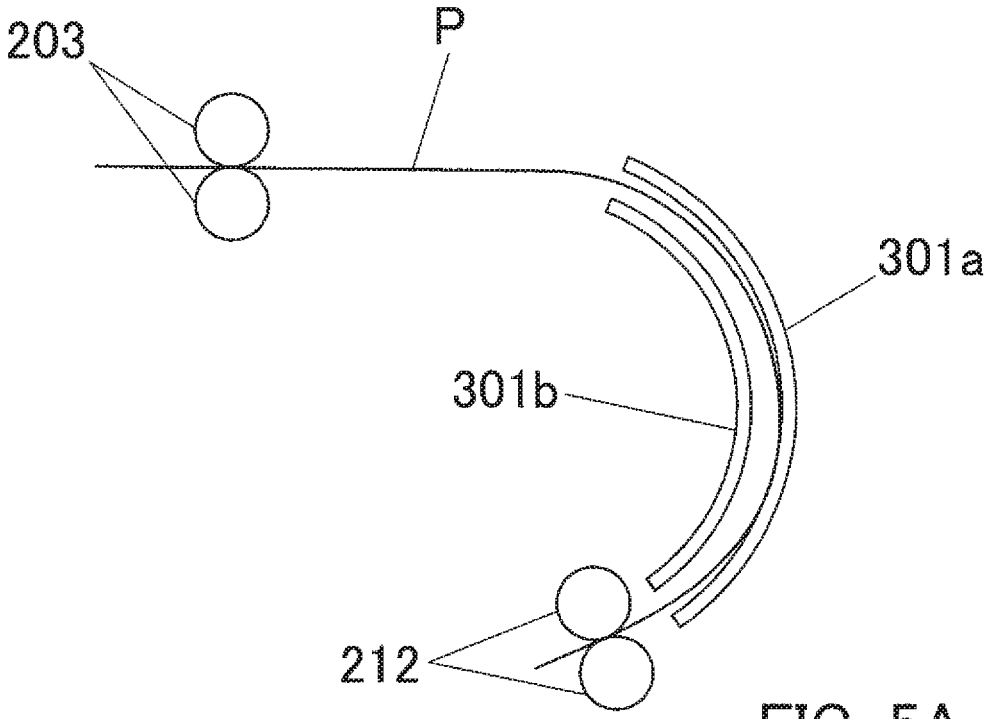
FIGS. 5A and 5B illustrate how the paper rubs against the paper conveyance guides.
Figure 5B:
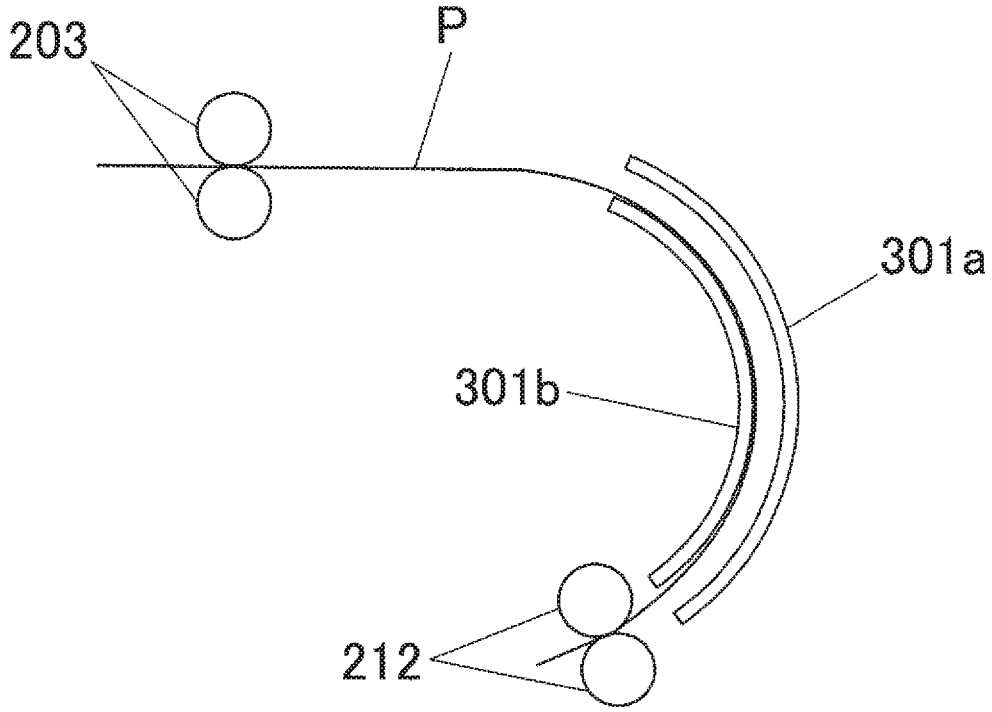

In this embodiment, controlled paper conveyance is performed on the condition where the load torque on the upstream roller 201 or the downstream roller 203 increases while these rollers convey the paper together or on the condition where the load torque on the upstream roller 212 or the downstream roller 203 increases while these rollers convey the paper together. As specified in Table 1 in FIG. 4, controlled paper conveyance is not performed for single-sided printing even on the condition where the load torque on the upstream roller 201 or the downstream roller 203 increases. Controlled paper conveyance is performed for double-sided printing on the condition where the load torque on the upstream roller 212 or the downstream roller 203 increases during paper conveyance. Specifically, controlled paper conveyance is performed for double-sided printing on that condition for the following reason. The paper conveyance path has a steep section between the upstream roller 212 and the downstream roller 203 as illustrated in FIG. 3, and the paper conveyance guides 301*a* and 301*b* to that section of the path are thus shaped in an arch having a large radius of curvature. While the paper P is passing along the paper conveyance path 301, an outer surface of a bend of the paper P can rub against the paper conveyance guide 301*a* that is the outer one, as referred to FIG. 5A. While the paper P is passing along the paper conveyance path 301, an inner surface of a bend of the paper P can rub against the paper conveyance guide 301*b* that is the inner one, as referred to FIG. 5B. The paper in either state causes an increase in the load torque on the upstream roller 212 or the downstream roller 203, and consequently causes an increase in the load torque on the driving motor 234 for the upstream roller 212 or the driving motor 233 for the downstream roller 203. The driving motors thus have to increase output torque. Controlled paper conveyance is aimed at minimizing an increase in the load torques on the upstream roller 212 and the downstream roller 203, and is consequently aimed at preventing the driving motors 234 and 233 from excessively increasing output torque.

Although, controlled paper conveyance is not necessary for double-sided printing using soft paper. That is because, soft paper rubbing against the paper conveyance guides 301*a* and 302*b* does not seriously affect the load torques on the upstream roller 212 and the downstream roller 203. So, as a precondition for this embodiment, controlled paper conveyance is performed for double-sided printing using tough paper.

Specifically, as specified in Table 1 of FIG. 4, controlled paper conveyance is not performed for double-sided printing using paper having a basis weight of 100 g/m2 or less, and controlled paper conveyance is performed for double-sided printing using paper having a basis weight of more than 100 g/m2.

Controlled paper conveyance may be also performed for single-sided printing as well as for double-sided printing on the condition where the load torque on the upstream or downstream roller increases because the paper rubs against one of the paper conveyance guides.

Controlled paper conveyance is performed by regulating the linear distance traveled by either or both of the upstream roller 212 and the downstream roller 203, i.e., by regulating the rotation speeds (RPMs) of either or both of the driving motor 234 for the upstream roller 212 and the driving motor 233 for the downstream roller 203. FIG. 6 shows Table 2 for reference in describing an example of a paper conveyance control method.

As specified in Table 2-1 of FIG. 6, if the load torque on the upstream roller 212 increases from normal by 2 mN m or more, the rotation speed of the driving motor 234 for the upstream roller 212 is reduced from normal (e.g. 2100 rpm) by 10%, for example, and the rotation speed of the driving roller 233 for the downstream roller 203 is increased from normal by 10%, for example. In other words, if the load torque on the upstream roller 212 is higher than normal, the image forming apparatus 1 judges that there is a friction force because an outer surface of a bend of the paper P rubs against the paper conveyance guide 301*a* that is the outer one, as referred in FIG. 5A. To eliminate this, the image forming apparatus 1 reduces the rotation speed of the driving motor 234 for the upstream roller 212 and increases the rotation speed of the driving motor 233 for the downstream roller 203.

As specified in Table 2-2 of FIG. 6, if the load torque on the downstream roller 203 increases from normal by 2 mN-m or more, the rotation speed of the driving motor 233 for the downstream roller 203 is reduced from normal (e.g. 2100 rpm) by 10%, for example, and the rotation speed of the driving roller 234 for the upstream roller 212 is increased from normal by 10%, for example. In other words, if the load torque on the downstream roller 203 is higher than normal, the image forming apparatus 1 judges that there is a friction force because an inner surface of a bend of the paper P rubs against the paper conveyance guide 301*b* that is the inner one, as referred to in FIG. SB. To eliminate this, the image forming apparatus 1 reduces the rotation speed of the driving motor 233 for the downstream roller 203 and increases the rotation speed of the driving motor 234 for the upstream roller 212.

As specified in Table 2-3 of FIG. 6, if the load torques on the upstream roller 212 and the downstream roller 203 increase by less than 2 mN·m, the last RPMs are maintained.

An increase in the load torque on the upstream roller 212 or the downstream roller 203 may be measured by percentages, not by absolute amount. In this case, for example, if the load torque on the upstream roller 212 or the downstream roller 203 increases from normal by 10%, i.e. 20 mN-m, the rotation speeds of the driving motor 234 and the driving motor 233 are regulated.

To estimate an increase, the load torques on the upstream roller 212 and the downstream roller 203 may be compared to their normal load torques measured when no paper is conveyed.

FIG. 7 shows Table 3 for reference in describing another example using different timings for starting paper conveyance depending on the type of paper, on the condition where the load torques on the upstream roller 212 and the downstream roller 203 are not sensed. Paper can be bent to some degree when the downstream roller 203 receives the paper from the upstream roller 212, and the size of the bend depends on the toughness (hardness) of the paper. The bend may be large enough to rub against the paper conveyance guide 301*a* that is the outer one, or may be small enough to rub against the paper conveyance guide 301*b* that is the inner one. To solve this, paper conveyance must start at different timings depending on the hardness of the paper. It is necessary to register different attributes depending on the type of paper and also specify different timings for starting conveyance distance regulation depending on the attribute. As specified in Table 3, the timing for starting is 100 ms for paper 1 having a basis weight of 200 g/m2 or less, 130 ms for paper 2 having a basis weight of 200 g/m2 or less, and 200 ms for paper 3 having a basis weight of more than 200 g/m2 to 300 g/m2, for example.

FIG. 8 is a chart for reference in describing an example of a paper conveyance control method on the condition where the load torques on the upstream roller 212 and the downstream roller 203 are not sensed. The chart shows changes in the target RPM of the driving motor 234 for the upstream roller 212 (to be referred to as "upstream motor") and of the driving motor 233 for the downstream roller 203 (to be referred to as "downstream motor"). After paper conveyance starts at the timing specified in Table 3, the target RPM of the upstream motor 234 and the downstream motor 233 is reduced and increased alternately by 10% at every 200 ms, for example, as indicated in the chart.

FIG. 9 is a block diagram illustrating a configuration of a sensor-less three-phase brushless motor 410 as a driving motor for each roller and of a motor controller 400 that controls the brushless motor 410. The motor controller 400 receives commands and a target rotation speed from a superordinate controller, the processor 100. Specifically, the motor controller 400 includes a rotation speed controller 401 that receives a target rotation speed, a current value of the brushless motor 410 measured by a current sensor 404, and the present speed calculated with reference to the voltage. The rotation speed controller 401 thus determines a PWM duty cycle, a duty cycle of a driving signal. More specifically, the motor controller 400 includes a drive element controller 402 that specifies a power on and off pattern, and the drive element controller 401 includes a speed calculator 402*b* that calculates the present speed. The drive element controller 402 generates a PWM signal using a PWM duty cycle received from the rotation speed controller 401 and using a pole position calculated by a pole position calculator 402*a* with reference to the current. The drive element controller 402 sends the PWM signal to the three-phase inverter circuit (drive element) 403 to make it drive the brushless motor 410.

Sensor-less vector control uses active and reactive current for speed control; the superordinate processor 100 converts active current (Iq) to torque.

Figure 10:
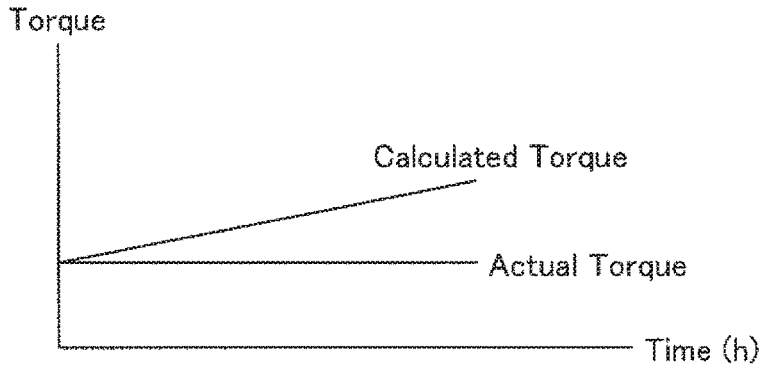
FIG. 10 is a chart showing changes of the load torque on the three-phase brushless motor when it is running in steady state.

FIG. 10 is a chart showing changes of the load torque on the three-phase brushless motor 410 as a driving motor for each roller when it is running in steady state. The magnetic flux changes while the motor is running in steady state due to change of temperature, causing an error in internal processing (position calculation). The flux linkage must be corrected to minimize the error and obtain a torque T with precision; a torque T is obtained by the equality: T=K*number of pole-pairs*Iq (Iq is an active current for speed control; K is a constant as a correction coefficient).

Figure 11:
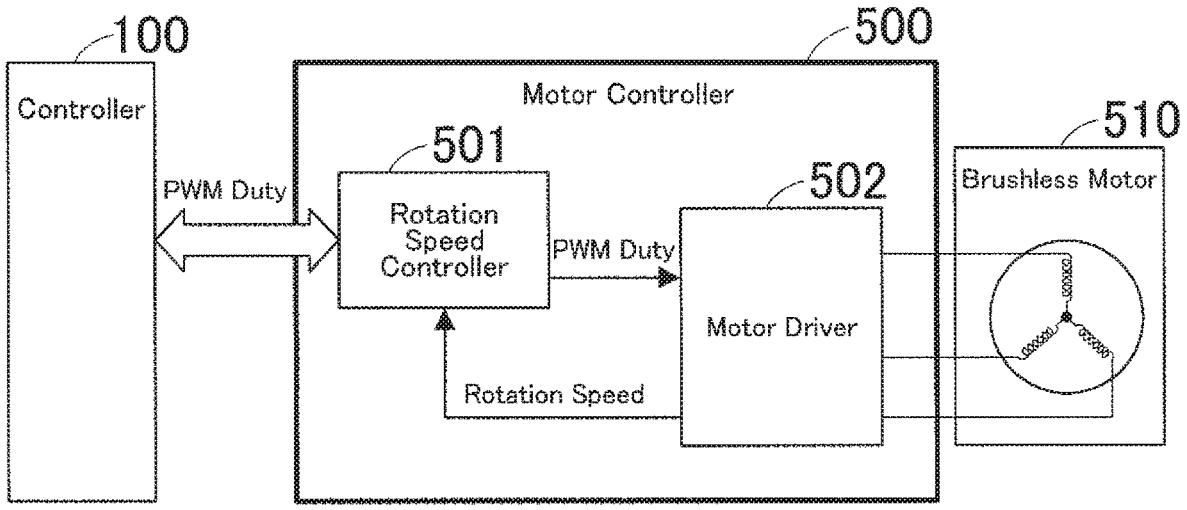
FIG. 11 is a block diagram illustrating a configuration of a PWM servomotor as a driving motor and of a motor controller that controls the PWM servomotor.

Each driving motor may be a PWM servomotor. FIG. 11 is a block diagram illustrating a configuration of a PWM servomotor 510 as a driving motor and of a motor controller 500 that controls the PWM servomotor 510. To adjust the rotation speed to the target speed, the motor controller 500 inputs control voltage (specified voltage) as a PWM duty cycle, to the PWM servomotor 510. As long as the PWM servomotor 510 runs at a constant speed, there is a steady increase in the load torque; and the motor controller 500 changes the PWM duty cycle depending on the load torque. So, the load torque can be calculated using the specified voltage. In particular, the controller 100 can calculate the load torque using a rate of change in the specified voltage.

Figure 12:
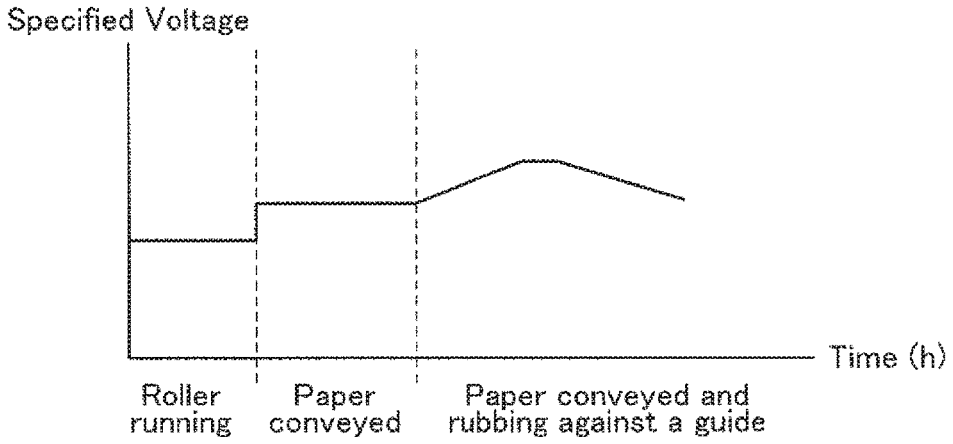
FIG. 12 is a chart showing changes of specified voltage depending on the load torque on the PWM servomotor.

FIG. 12 is a chart showing changes of specified voltage depending on the load torque on the PWM servomotor 510. The load torque increases when the upstream roller 212 or the downstream roller 203 starts running, when paper conveyance starts, and when paper rubs against the paper conveyance guides 301*a* or 301*b*. As specified in Table 2 shown in FIG. 6, the motor controller 500 regulates the rotation speeds of the upstream motor 234 and the downstream motor 233 by reducing and increasing specified voltage from normal by 10%. The normal specified voltage is measured during paper conveyance.

Figure 13:
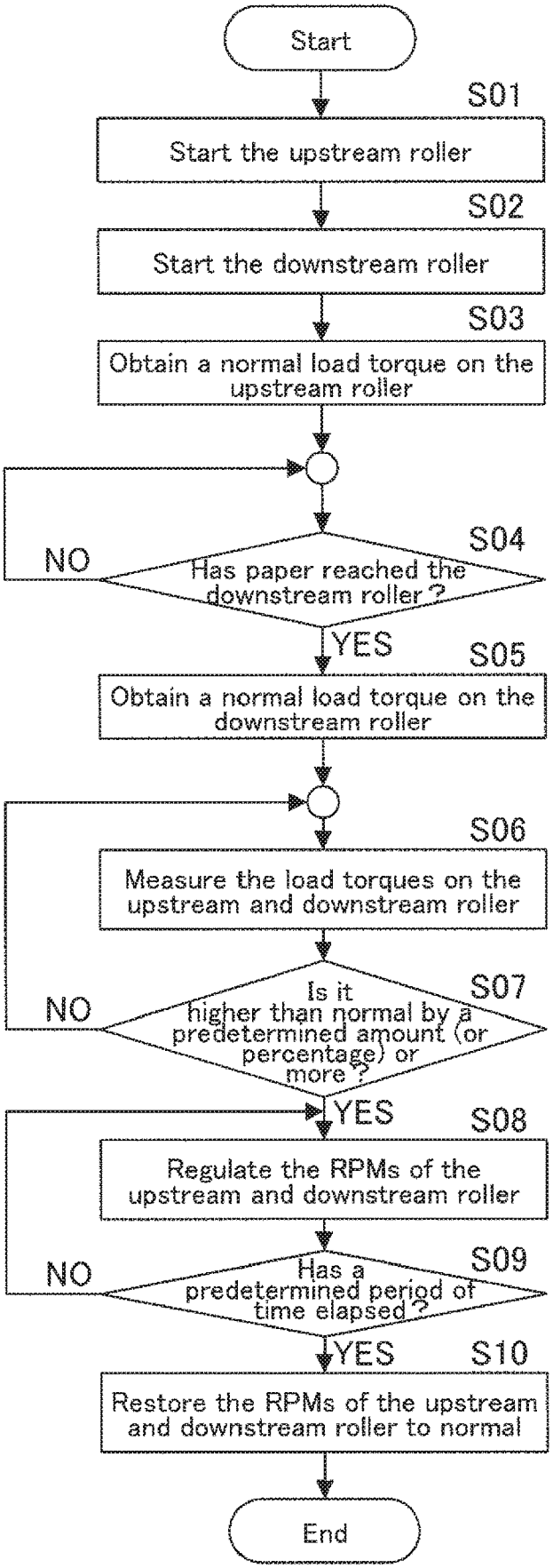
FIG. 13 is a flowchart representing an example of controlled paper conveyance of the image forming apparatus.

FIG. 13 is a flowchart representing an example of controlled paper conveyance of the image forming apparatus 1. The image forming apparatus 1 performs controlled paper conveyance according to the flowcharts of FIG. 13 and the following figures, by the CPU 101 of the processor 100 running paper conveyance control programs stored on a recording medium such as the ROM 12.

The upstream roller 212 starts running in Step S01; the downstream roller 203 starts running in Step S02. In Step S03, the load torque on the upstream roller 212 is measured during paper conveyance as its normal load torque.

In Step S04, it is judged whether or not paper has reached the downstream roller 203. If it has not reached (NO in Step S04), the procedure waits until it has reached. If it has reached (YES in Step S04), the load torque on the downstream roller 203 is measured during paper conveyance as its normal load torque, in Step S05.

In Step S06, the load torques on the upstream roller 212 and the downstream roller 203 are measured. In Step S07, it is judged whether the load torque on the upstream roller 212 or the downstream roller 203 is higher than normal by a predetermined amount or more or by a predetermined percentage or more. If it is not higher than normal (NO in Step S07), the procedure returns to Step S06. If it is higher than normal (YES in Step S07), the rotation speeds (RPMs) of the upstream roller 212 (the upstream motor 234) and the downstream roller 203 (the downstream motor 233) are regulated as specified in Table 2-2 of FIG. 6, in Step S08. In Step S09, it is judged whether or not a predetermined period of time has elapsed. If a predetermined period of time has not elapsed (NO in Step S09), the procedure returns to Step S08 to maintain the specified RPMs. If a predetermined period of time has elapsed (YES in Step S09), the rotation speeds of the upstream roller 212 and the downstream roller 203 are restored to normal in Step S10.

Figure 14:
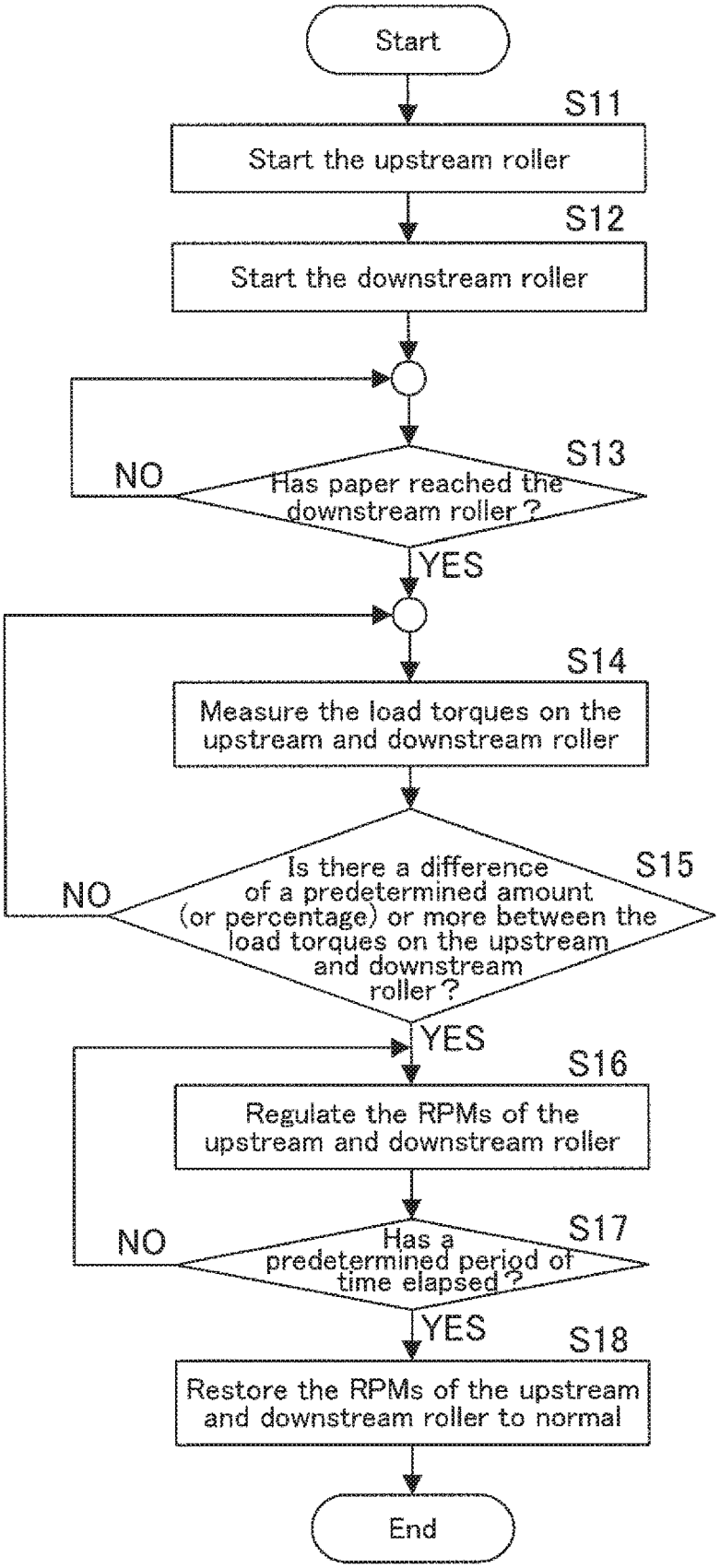
FIG. 14 is a flowchart representing another example of controlled paper conveyance of the image forming apparatus.

FIG. 14 is a flowchart representing another example of controlled paper conveyance of the image forming apparatus 1.

The upstream roller 212 starts running in Step S11; the downstream roller 203 starts running in Step S12. In Step S13, it is judged whether or not paper has reached the downstream roller 203. If it has not reached (NO in Step S13), the procedure waits until it has reached. If it has reached (YES in Step S13), the load torques on the upstream roller 212 and the downstream roller 203 are measured in Step S14.

In Step S15, it is judged whether or not there is a difference of a predetermined amount or more or there is a difference of a predetermined percentage or more between the load torques on the upstream roller 212 and the downstream roller 203. If there is not such a difference (NO in Step S15), the procedure returns to Step S14. If there is a difference of a predetermined amount or more or there is a difference of a predetermined percentage or more (YES in Step S15), the rotation speeds (RPMs) of the upstream roller 212 (the upstream motor 234) and the downstream roller 203 (the downstream motor 233) are regulated as specified, in Step S16. In Step S17, it is judged whether or not a predetermined period of time has elapsed. If a predetermined period of time has not elapsed (NO in Step S17), the procedure returns to Step S16 to maintain the specified RPMs. If a predetermined period of time has elapsed (YES in Step S17), the rotation speeds of the upstream roller 212 and the downstream roller 203 are restored to normal in Step S18.

Figure 15:
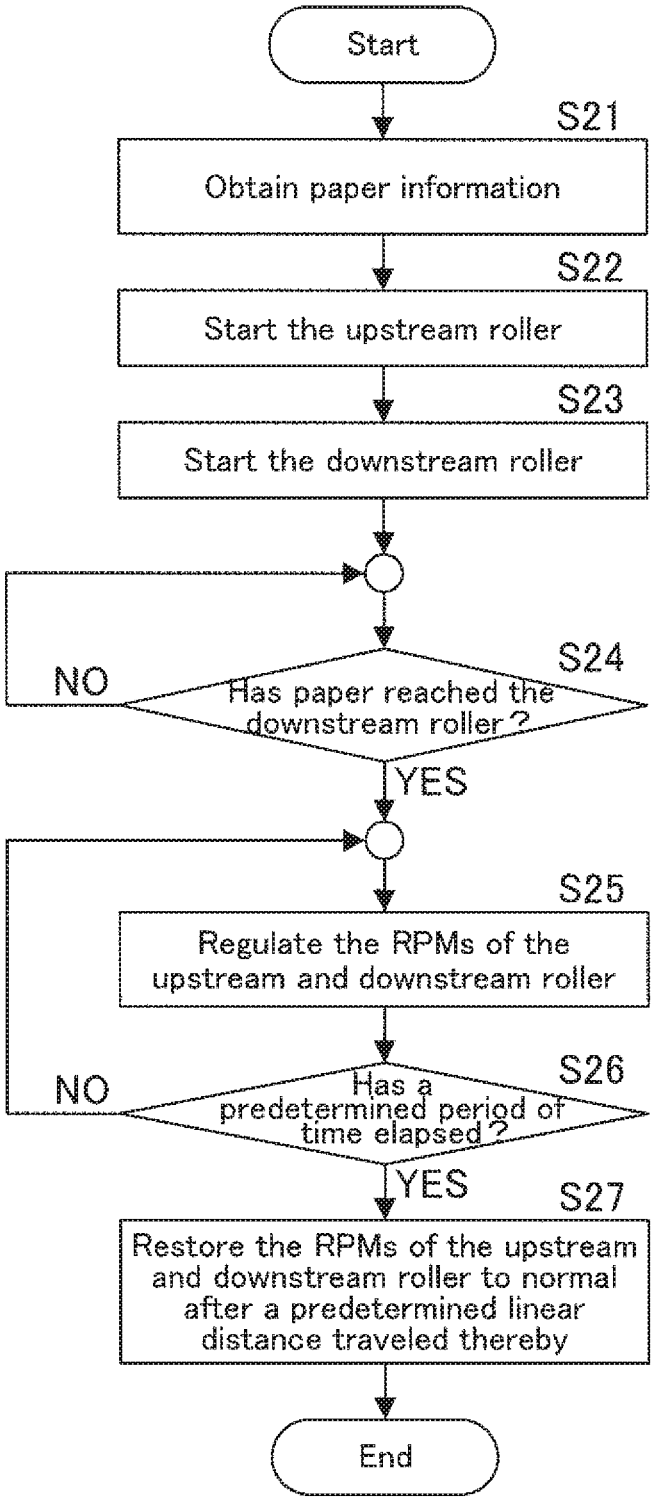
FIG. 15 is a flowchart for reference in describing an example of controlled paper conveyance of the image forming apparatus on the condition where the load torques on the upstream and downstream roller are not sensed.

FIG. 15 is a flowchart for reference in describing an example of controlled paper conveyance of the image forming apparatus 1 on the condition where the load torques on the upstream roller 212 and the downstream roller 203 are not sensed.

Paper information is obtained in Step S21: the upstream roller 212 starts running in Step S22; the downstream roller 203 starts running in Step S23. In Step S24, it is judged whether or not paper has reached the downstream roller 203. If it has not reached (NO in Step S24), the procedure waits until it has reached. If it has reached (YES in Step S24), the rotation speeds (RPMs) of the upstream roller 212 (the upstream motor 234) and the downstream roller 203 (the downstream motor 233) are regulated as specified in FIG. 8, in Step S25. In Step S26, it is judged whether or not a predetermined period of time has elapsed. If a predetermined period of time has not elapsed (NO in Step S26), the procedure returns to Step S25. If a predetermined period of time has elapsed (YES in Step S26), the procedure proceeds to Step S27, in which the rotation speeds of the upstream roller 212 and the downstream roller 203 are restored to normal after a predetermined linear distance traveled thereby.

As described above, in this embodiment, it is judged whether or not paper is rubbing against the paper conveyance guide 301*a* or 301*b* with reference to the load torques on the upstream roller 212 and the downstream roller 203. Depending on the result of the judgment, controlled paper conveyance is performed with reference to the load torques on the upstream roller 212 and the downstream roller 203. This embodiment is thus capable of minimizing an increase in the load torques on the upstream roller 212 and the downstream roller 203, caused by the paper rubbing against the paper conveyance guides 301*a* and 301*b*.

Although one or more embodiments of the present invention have been described and illustrated in detail, the disclosed embodiments are made for purposes of illustration and example only and not limitation. The scope of the present invention should be interpreted by terms of the appended claims.

What is claimed is:

1. A paper conveyance device comprising:

an upstream roller and a downstream roller arranged at an interval in a paper conveyance path;

paper conveyance guides arranged between the upstream and downstream rollers in the paper conveyance path to guide both surfaces of paper along the paper conveyance path during paper conveyance;

drivers that drive the upstream and downstream rollers independently; and a processor that measures load torques on the upstream and downstream rollers, makes a judgment as to whether or not the paper is rubbing against one of the paper conveyance guides with reference to the load torques on the upstream and downstream rollers, and performs controlled paper conveyance with reference to the load torques on the upstream and downstream rollers depending on a result of the judgment, wherein the processor judges that the paper is rubbing against an outer one of the paper conveyance guides if there is a large increase in the load torque on the upstream roller during paper conveyance, and the processor judges that the paper is rubbing against an inner one of the paper conveyance guides if there is a large increase in the load torque on the downstream roller.

2. The paper conveyance device according to claim 1, wherein:

the drivers are an upstream motor and a downstream motor, the upstream motor driving the upstream roller, the downstream motor driving the downstream roller; and the processor performs the controlled paper conveyance by regulating a rotation speed of one or both of the upstream and downstream motors.

3. The paper conveyance device according to claim 1, wherein the processor performs the controlled paper conveyance only if the load torque on at least one of the upstream and downstream rollers increases by a predetermined value or more during paper conveyance.

4. The paper conveyance device according to claim 3, wherein each of the paper conveyance guides is shaped in an arch having a large radius of curvature.

5. The paper conveyance device according to claim 3, wherein the load torque on at least one of the upstream and downstream rollers increases by the predetermined value or more during paper conveyance due to the paper having a basis weight that is higher than a set basis weight.

6. The paper conveyance device according to claim 1, wherein the processor regulates the drivers to make the upstream roller run slower than the downstream roller if the paper is rubbing against the outer one of the paper conveyance guides, and the processor regulates the drivers to make the downstream roller run slower than the upstream roller if the paper is rubbing against the inner one of the paper conveyance guides.

7. The paper conveyance device according to claim 2, wherein the processor measures the load torques by calculation using current values of the upstream and downstream motors.

8. The paper conveyance device according to claim 2, wherein:

the upstream and downstream motors are servomotors; and the processor measures the load torques by calculation using a rate of change in specified voltage output by the servomotors.

9. An image forming apparatus comprising the paper conveyance device according to claim 1.

10. A paper conveyance control method to be implemented by a paper conveyance device that includes (i) an upstream roller and a downstream roller arranged at an interval in a paper conveyance path, (ii) paper conveyance guides arranged between the upstream and downstream rollers in the paper conveyance path to guide both surfaces of paper along the paper conveyance path during paper conveyance, and (iii) drivers that drive the upstream and downstream rollers independently, the paper conveyance control method comprising:

measuring load torques on the upstream and downstream rollers;

judging whether or not the paper is rubbing against one of the paper conveyance guides with reference to the load torques on the upstream and downstream rollers, the judging comprising judging that the paper is rubbing against an outer one of the paper conveyance guides if there is a large increase in the load torque on the upstream roller during paper conveyance, and judging that the paper is rubbing against an inner one of the paper conveyance guides if there is a large increase in the load torque on the downstream roller; and performing controlled paper conveyance with reference to the load torques on the upstream and downstream rollers depending on a result of the judging. judgment being obtained.

11. A non-transitory computer-readable recording medium storing a paper conveyance control program for a paper conveyance device that includes (i) an upstream roller and a downstream roller arranged at an interval in a paper conveyance path, (ii) paper conveyance guides arranged between the upstream and downstream rollers in the paper conveyance path to guide both surfaces of paper along the paper conveyance path during paper conveyance, and (iii) drivers that drive the upstream and downstream rollers independently, the paper conveyance control program being executable by a computer of the paper conveyance device to perform processes comprising:

measuring load torques on the upstream and downstream rollers;

judging whether or not the paper is rubbing against one of the paper conveyance guides with reference to the load torques on the upstream and downstream rollers, the judging comprising judging that the paper is rubbing against an outer one of the paper conveyance guides if there is a large increase in the load torque on the upstream roller during paper conveyance, and judging that the paper is rubbing against an inner one of the paper conveyance guides if there is a large increase in the load torque on the downstream roller; and performing controlled paper conveyance with reference to the load torques on the upstream and downstream rollers depending on a result of the judging.

12. The paper conveyance device according to claim 1, wherein the processor judges that there is a large increase in the load torque on the upstream roller during paper conveyance when the load torque on the upstream roller increases by a threshold amount or more, and the processor judges that there is a large increase in the load torque on the downstream roller when the load torque on the downstream roller increases by the threshold amount or more.

13. The paper conveyance control method according to claim 10, wherein the judging comprises:

judging that there is a large increase in the load torque on the upstream roller during paper conveyance when the load torque on the upstream roller increases by a threshold amount or more; and judging that there is a large increase in the load torque on the downstream roller when the load torque on the downstream roller increases by the threshold amount or more.

14. The non-transitory computer-readable recording medium according to claim 11, wherein the judging comprises:

judging that there is a large increase in the load torque on the upstream roller during paper conveyance when the load torque on the upstream roller increases by a threshold amount or more; and judging that there is a large increase in the load torque on the downstream roller when the load torque on the downstream roller increases by the threshold amount or more.

* * * * *